US006048453A

United States Patent [19]

King, Jr.

[11] Patent Number: 6,048,453

[45] Date of Patent: Apr. 11, 2000

[54] SWIMMING POOL SKIMMER VALVE SYSTEM

[76] Inventor: Kenneth W. King, Jr., 6126 La Flecha, Rancho Santa Fe, Calif. 92067

[21] Appl. No.: 09/139,857

[22] Filed: Aug. 25, 1998

[51] Int. Cl.[7] ..... E04H 3/16; G05D 11/02

[52] U.S. Cl. ..... 210/169; 210/416.2; 137/111; 137/625.41; 4/509

[58] Field of Search ..... 210/169, 232, 210/416.2; 4/507, 509; 15/1.7; 137/109, 111, 625.41

[56] References Cited

U.S. PATENT DOCUMENTS 3,626,972 12/1971 Lorenzen .
3,701,427 10/1972 Howard .
3,801,992 4/1974 Sable .
3,966,598 6/1976 Ettelt .
4,185,333 1/1980 Ortega .
4,454,035 6/1984 Stefan .
4,643,217 2/1987 Frentzel .
4,725,352 2/1988 Haliotis .
5,581,826 12/1996 Edwards .

*Primary Examiner*—David A. Simmons
*Assistant Examiner*—Fred Prince
*Attorney, Agent, or Firm*—Brown, Martin, Haller & McClain, LLP

[57] ABSTRACT

A skimmer valve system for a swimming pool includes a skimmer mounted in a wall of the swimming pool that has an intake port coupled via a primary suction pipe to the suction system of the swimming pool, and further includes a valve mounted in the intake port of the skimmer, and a secondary suction pipe coupled into the primary suction pipe. The other end of the secondary suction pipe terminates at a coupling in a wall of the pool or a similarly convenient location for connecting a conventional pool cleaner. Adjusting the valve controls the division of the total suction between the skimmer and the pool cleaner.

10 Claims, 2 Drawing Sheets

SWIMMING POOL SKIMMER VALVE SYSTEM

BACKGROUND OF THE INVENTION

1. Field of the Invention

The present invention relates to swimming pool systems and, more specifically, to controlling the proportion of suction between a skimmer and a pool cleaner.

2. Description of the Related Art

As illustrated in FIG. 1 (not to scale), a swimming pool filtration system for an in-ground pool 10 typically includes a pump 12, a filter unit 14, and one or more skimmers 16. Skimmer 16 is located in the wall of pool 10 approximately at the average waterline 18. Skimmer 16 essentially comprises a box 20 that typically has a hinged flap or weir 22 that opens to admit water. Skimmer 16 is connected to filter unit 14 and pump 12 via a suction line 24. The water is pumped through filter unit 14 and returned to pool 10 via one or more return lines 26. An equalizer line 25 connects skimmer 16 to the main drain 27 of pool 10 and provides water to skimmer 16 to equalize pressure and prevent pump 12 from running dry in the event skimmer 16 becomes clogged. Leaves or other debris floating on the surface of the water are sucked into skimmer 16 and captured by a strainer basket (not shown) or filter unit 14.

A robotic cleaner 28 may also be included in certain pool filter systems. Cleaner 28 is a device that moves along the pool bottom and vacuums debris. Cleaner 28 can be connected to a coupling 29 in the wall of pool 10, which is in turn connected to pump 12 via a secondary suction line 30 that is coupled to (primary) suction line 24 at a junction valve box 32. A user can connect cleaner 28 to coupling 29 when the user desires to operate cleaner 28 and disconnect cleaner 28 from coupling 29 at other times, such as when swimmers are using the pool. Junction valve box 32 is typically located nearer pump 12 than pool 10. Junction valve box 32 is typically embedded in the concrete deck 34 that surrounds pool 10. Junction valve box 32 has a lid that can be removed to access its interior. Inside junction valve box 32 is a two-way valve (not shown) that proportionally controls the flow from skimmer 16 to pump 12 in relation to the flow from cleaner 28 to pump 12. In other words, if the valve is in one of its two extreme positions, it completely closes the path between cleaner 28 and pump 12 and completely opens the path between skimmer 16 and pump 12. Thus, pump 12 applies suction only to skimmer 16. If the valve is in the other of its two extreme positions, it completely opens the path between cleaner 28 and pump 12 and completely closes the path between skimmer 16 and pump 12. Thus, pump 12 applies suction only to cleaner 28. If the valve is in a mid-position, halfway between its two extreme positions, cleaner 28 and skimmer 16 experience equal suction from pump 12.

The inclusion of cleaner 28 in the filter system substantially increases the cost of pool construction because the installation of valve boxes and underground pipe runs are significant components of the cost. The pool construction company must install secondary suction line 30 that extends between coupling 29 and junction valve box 32, a distance that may exceed 50 or 100 feet in some pool systems. Furthermore, it is typically inconvenient for a pool owner or maintenance personnel to operate the valve while setting up cleaner 28 because junction valve box 32 is located relatively far from pool 10.

In addition, cement contractors have been known on occasion to inadvertently cement-over junction valve box 32 when pouring the cement for deck 34. Rather than engage in an uneconomical remediation procedure involving sawing through the concrete, repairing (or replacing) valve box 32, and patching up the cement work, if by good fortune or foresight the valve was in its mid-position or thereabout at the time junction valve box 32 was cemented over, the pool construction company may cleverly mitigate the cement contractor's error by leaving valve box 32 in its cemented-over state and placing a flow restrictor in the intake of skimmer 16 where it is coupled to suction line 30. The restrictor typically consists of a plug having a number of holes drilled in it that achieves a desired suction balance between skimmer 16 and cleaner 28. Typically, the intake of a skimmer 16 is already internally threaded to enable a plug to be screwed into it to facilitate pressure testing of the filter system. Thus, the pool construction company, in mitigating a cement contractor's error by this method, may simply screw such a plug into the intake and drill a number of holes through it until the total available suction created by pump 12 is divided in a selected proportion between skimmer 16 and secondary suction line 30. The greater the number of holes, the lesser the proportion of the suction that is diverted to secondary suction line 30.

It would be desirable to provide an improved system for controlling the proportion of suction between a skimmer and a pool cleaner that is economical to install and convenient to use. These needs are satisfied by the present invention in the manner described below.

SUMMARY OF THE INVENTION

The present invention relates to a skimmer valve system for a swimming pool. The system includes a skimmer mounted in a wall of the swimming pool in the conventional manner. In accordance with the invention, a valve is mounted in the intake port of the skimmer that is coupled to the suction system of the swimming pool via a primary suction pipe. A user may adjust the valve to control the flow of water from the skimmer into the primary suction pipe. The system also includes a secondary suction pipe coupled into the primary suction pipe. The other end of the secondary suction pipe terminates at a suitable coupling in a wall of the pool or a similarly convenient location for connecting and disconnecting a conventional pool cleaner.

Adjusting the valve controls the division of the total suction between the skimmer and the pool cleaner. In other words, the user may adjust the valve to control the proportion of suction afforded to the skimmer with respect to the proportion of suction experienced by the pool cleaner. Opening the valve wider decreases the proportion of the suction that is diverted to the secondary suction line and pool cleaner and increases the proportion of the suction that the skimmer experiences. Closing down the valve increases the proportion of the suction that is diverted to the secondary suction line and the pool cleaner and decreases the proportion of the suction that is experienced by the skimmer.

The invention may be retrofitted into an existing swimming pool by mounting a suitable valve in the intake port of the skimmer. The valve may be used in place of an existing valve that is conventionally provided in a remotely located junction valve box for controlling the proportion of suction between the skimmer and a pool cleaner. The present invention improves convenience and ease of use because the valve of the present invention is nearer to the pool and the pool cleaner than the existing valve. Another advantage of the invention is that the valve can be used to adjust the relative flow among multiple skimmers. In other words, the valve of each skimmer can be adjusted to equalize or balance the flow relative to the flow of the other skimmers.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF A PREFERRED EMBODIMENT

Figure 2:
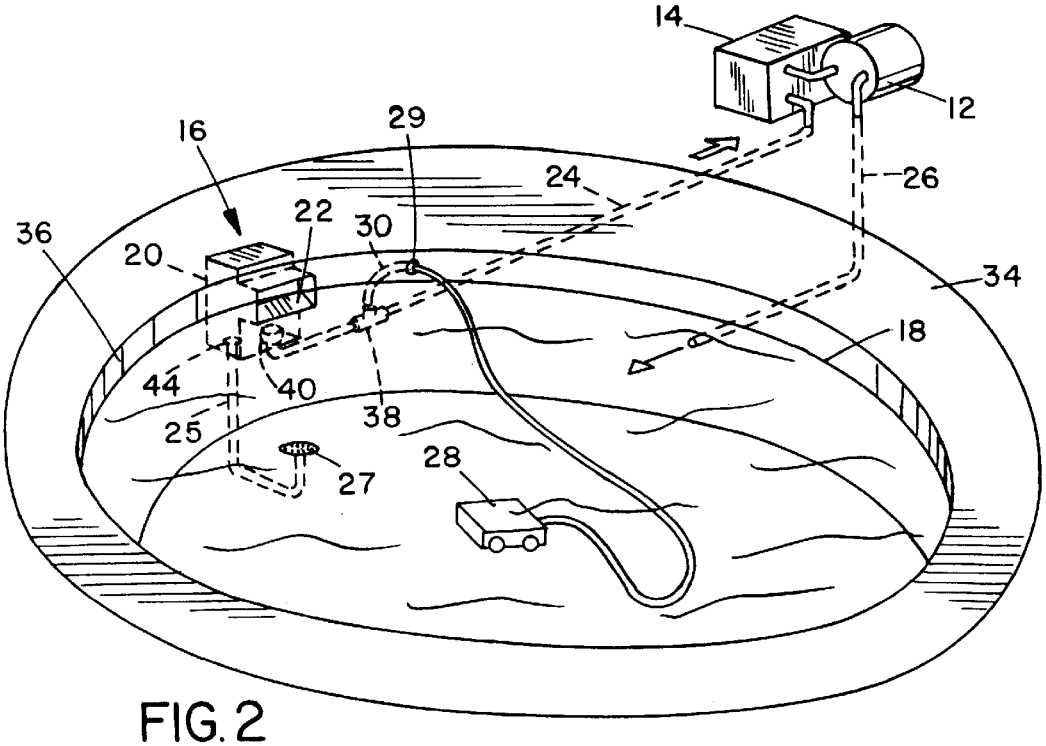
FIG. 2 illustrates a swimming pool system that includes the present invention.

As illustrated in FIG. 2 (not to scale), a swimming pool filtration system for an in-ground pool 36 includes a pump 12, a filter unit 14, and one or more skimmers 16. Skimmer 16 is located in the wall of pool 10 approximately at the average waterline 18. Skimmer 16 essentially comprises a box 20 with a hinged flap or weir 22 that opens to admit water. Skimmer 16 is connected to pump 12 via a primary suction line 24. The water is pumped through filter unit 14 and returned to skimmer 16 via return line 26. Leaves or other debris floating on the surface of the water are sucked into the weir and captured by filter unit 14. A robotic cleaner 28 is connectable to and disconnectable from a coupling 29 in the wall of pool 10, which is in turn connected to pump 12 via a secondary suction line 30. Secondary suction line 30 is coupled to (primary) suction line 24 at a tee fitting 38 beneath the concrete deck 34.

Figure 1:
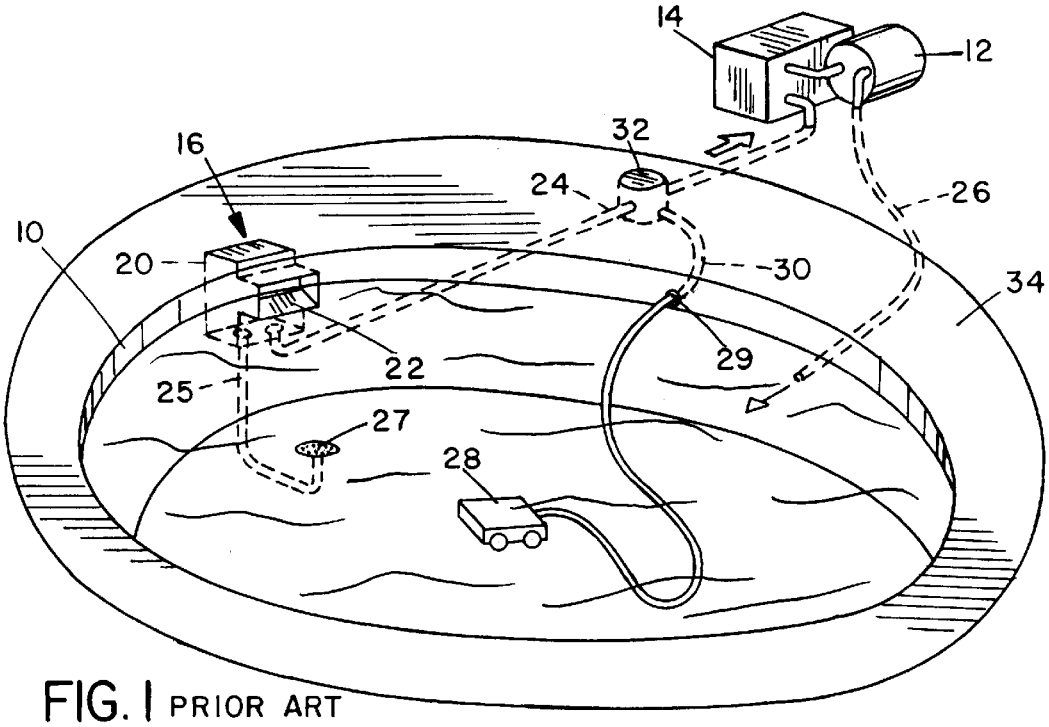
FIG. 1 PRIOR ART
FIG. 1 illustrates a swimming pool system as known in the prior art.
Figure 3:
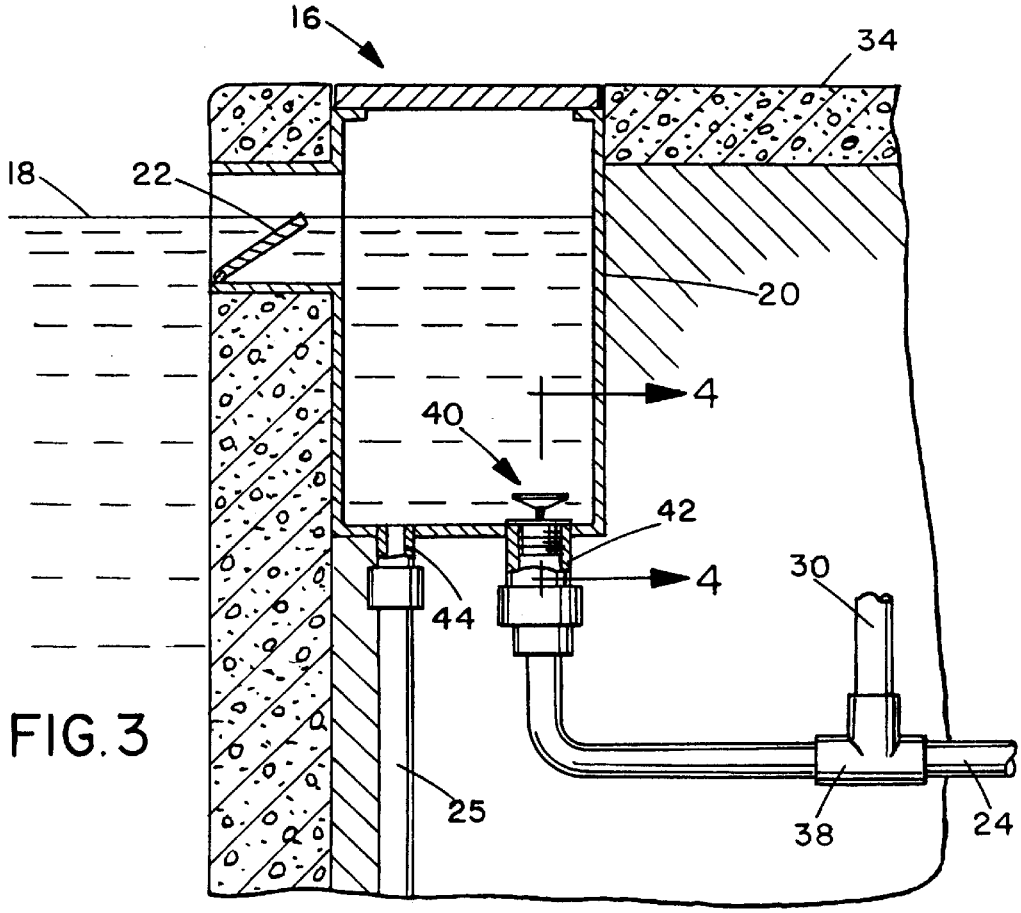
FIG. 3 is an enlarged sectional view of a skimmer that includes the flow control valve of the present invention.

As illustrated in FIG. 3, a flow control valve 40 is mounted in the intake port 42 of skimmer 16. Intake port 42 is coupled to primary suction line 24, and a discharge port 44 is coupled to return line 26 in the conventional manner. Indeed, a user may retrofit valve 40 into an existing skimmer 16 of a conventional swimming pool system such as that illustrated in FIG. 1. Such a retrofit may be used, for example, to mitigate an inadvertent cementing-over of junction valve box 32. The primary advantage of the invention, however, is realized by the omission from the system of junction valve box 32 (FIG. 1) during pool construction. Flow control valve 40 provides an essentially equivalent function to that of valve junction box 32 and its valve, but is more economical and more readily accessible by a user. It is more economical to install than valve junction box 32 because tee fitting 38 can be located very close to skimmer 16, thus minimizing the length of secondary suction line 30 that must be installed. Installing underground pipe lines is a significant portion of the cost of pool construction, and the invention can shorten secondary suction line 30 by perhaps 50 or more feet in some pool installations. Flow control valve 40 is convenient to use since it is located at the edge of pool 10 rather than closer to pump 12.

Figure 4:
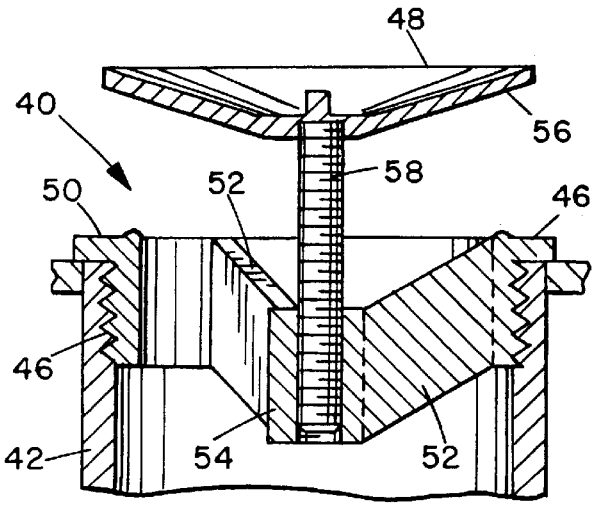
FIG. 4 is an enlarged sectional view taken on line 4—4 of FIG. 3.
Figure 5:
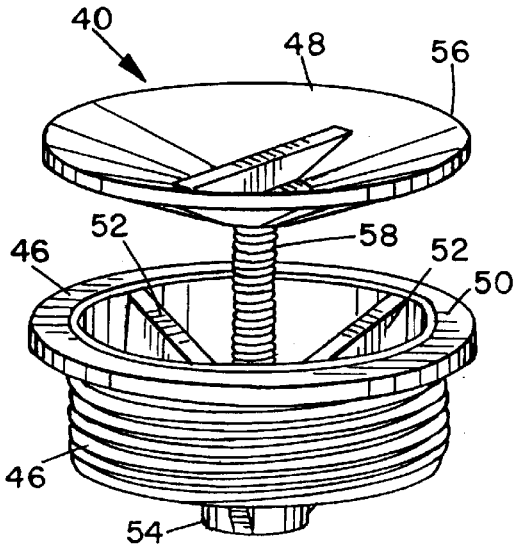
FIG. 5 is a perspective view of flow control valve.

To install valve 40, a user reaches inside skimmer 16 and screws valve 40 into intake port 42. As illustrated in FIGS. 4–5, valve 40 includes a valve body 46 and a valve stem 48. Intake port 42 of many commercially available skimmers 16 is internally threaded. Thus, valve body 46 is preferably correspondingly externally threaded to engage the threads of intake port 42. In the illustrated valve 40, valve body 46 has a threaded annular rim 50, three spokes 52, and a central internally threaded cylinder portion 54. Valve stem 48 has a disc portion 56 and a threaded rod portion 58. Disc portion 56 has a means for gripping it with fingers or a tool, such as a crossbar that can be grasped between the user's thumb and forefinger or a slot that can be engaged by a large screwdriver or coin. To install valve 40, the user can remove threaded rod portion 58 by unscrewing it from threaded cylinder portion 54, screw valve body 46 into intake port 42 by grasping spokes 52, and replace threaded rod portion 58 by screwing it back into threaded cylinder portion 54.

Valve 40 can be conveniently adjusted to control the division of the total suction between skimmer 16 and pool cleaner 28. In response to the user rotating valve stem 48 in internally threaded cylinder portion 54, valve stem 48 moves in an axial direction, whereby disc portion 56 moves axially toward or away from valve body 46. Rotating valve stem 48 until disc portion 56 contacts annular rim 50, which functions as a valve seat, closes valve 40 and completely prevents flow. Rotating valve stem 48 until disc portion 56 is relatively far from annular rim 50 opens valve 40 and permits maximum flow. Valve 40 thus is adjustable over a continuous range of flows. Although valve 40 is economical and convenient to use, it should be noted that other valve designs may be suitable.

Opening valve 40 wider decreases the proportion of the suction that is diverted to secondary suction line 30 and pool cleaner 28 and increases the proportion of the suction that skimmer 16 experiences. Closing down valve 40 increases the proportion of the suction that is diverted to secondary suction line 30 and pool cleaner 28 and decreases the proportion of the suction that skimmer 16 experiences.

It will be evident that there are numerous embodiments of the present invention, which, while not specifically described above, are clearly within the scope and spirit of the invention. Consequently, the above description is considered to be exemplary only, and the full scope of the invention is to be determined solely by the appended claims.

What is claimed is:

1. A skimmer valve system for a swimming pool having a suction system, comprising:

a skimmer mounted in a wall of said swimming pool, said skimmer having an intake port;

a valve mounted in said intake port, said valve having a continuously adjustable flow;

a coupling mounted in the wall of said swimming pool for connection to a pool cleaner;

a primary suction pipe having a first end coupled to said intake port and a second end coupled to said suction system, said valve controlling said flow from said skimmer into said primary suction pipe;

said primary suction pipe having a T-junction spaced between said first and second ends, said T-junction having a connecting portion for unimpeded flow along said primary suction pipe through said T-junction, and a side inlet connected into said connecting portion; and a secondary suction pipe having a first end coupled to said side inlet into said primary suction pipe and a second end coupled to said coupling at said swimming pool wall for connecting a pool cleaner.

2. The skimmer valve system recited in claim 1, wherein said valve has a rotatable valve stem threadably coupled to a valve body for moving said valve stem axially with respect to said valve body in response to rotation of said valve stem.

3. The skimmer valve system recited in claim 1, wherein said valve has a threaded body for threadably engaging said intake port of said skimmer.

4. The skimmer valve system recited in claim 1, further comprising a pool cleaner connectable to said coupling at said swimming pool.

5. A method for making a skimmer valve system for a swimming pool having a suction system, comprising the steps of:

providing a swimming pool having a primary suction pipe with a first end coupled to an intake port of said skimmer and a second end coupled to said suction system;

providing a T-junction in the primary suction pipe with a connecting portion for unimpeded flow along said primary suction pipe and a branch inlet extending transversely into said connecting portion;

providing a secondary suction pipe with a first end coupled to said branch inlet into said T-junction of said primary suction pipe and a second end coupled to a second pool cleaning device; and mounting a valve in an intake port of said skimmer spaced from the T-junction and secondary suction pipe, said valve having a continuously adjustable flow, said valve controlling said flow from said skimmer into said primary suction pipe and the division of suction between the skimmer and second pool cleaning device.

6. The method recited in claim 5, wherein said valve has a rotatable valve stem threadably coupled to a valve body for moving said valve stem axially with respect to said valve body in response to rotation of said valve stem.

7. The method recited in claim 5, wherein said valve has a threaded body, and said mounting step comprises threadably engaging said body of said valve in said intake port of said skimmer.

8. The method as claimed in claim 5, further comprising the steps of providing a coupling in the wall of said swimming pool, connecting the second end of said secondary suction pipe to said coupling, and connecting a pool cleaner to said coupling at said swimming pool wall.

9. The system as claimed in claim 1, wherein the skimmer has a cavity with a base wall, the intake port being located in the base wall of the skimmer cavity, and the valve comprises a two way valve in said intake port having a single inlet from said skimmer cavity, a single outlet, and an adjustable valve member controlling the size of said inlet.

10. A skimmer valve system for a swimming pool having a suction system, comprising:

at least one skimmer mounted in a wall of said swimming pool, said skimmer having an intake port;

a valve mounted in said intake port, said valve having a continuously adjustable flow;

at least one second pool cleaning device in the swimming pool, the second pool cleaning device having an intake port;

a primary suction pipe having a first end coupled to said intake port and a second end coupled to said suction system, said valve controlling said flow from said skimmer into said primary suction pipe;

said primary suction pipe having a three way junction spaced between said first and second ends dividing said primary suction pipe into a first portion extending from said first end to said junction and a second portion extending from said junction to said second end, said junction having a first inlet connected to said first portion of said primary suction pipe, an outlet connected to said second portion of said primary suction pipe with said junction providing unimpeded flow of water from said first inlet to said outlet, and a second inlet into said junction; and a secondary suction pipe having a first end coupled to said second inlet into said second portion of said primary suction pipe and a second end coupled to said intake port of said second pool cleaning device;

whereby said valve controls the division of suction between said skimmer and said second pool cleaning device.

* * * * *